United States Patent [19]

Danon

[11] 4,176,772

[45] Dec. 4, 1979

[54] WATER CONTAINER

[75] Inventor: David Danon, Rehovot, Israel

[73] Assignee: Yeda Research & Development Co. Ltd., Rehovot, Israel

[21] Appl. No.: 812,910

[22] Filed: Jul. 5, 1977

[30] Foreign Application Priority Data

Jul. 5, 1976 [IL] Israel ..... 49974

[51] Int. Cl.[2] ..... A45F 3/20

[52] U.S. Cl. ..... 224/148; 9/340; 224/214

[58] Field of Search ..... 224/5 W, 5 R, 8 R, 9, 224/10, 11, 5 H, 26 C, 26 H, 26 J, 148, 202, 210, 214, 250; 9/340, 345; 2/300, 310, 311, 326

[56] References Cited

U.S. PATENT DOCUMENTS

| | | | |
|---|---|---|---|
| 278,432 | 5/1883 | Hoeflich | 9/340 |
| 790,682 | 5/1905 | Friedman | 9/340 |
| 1,077,800 | 11/1913 | Butters | 9/340 |
| 1,536,965 | 5/1925 | Ocker | 224/26 C |
| 1,650,764 | 11/1927 | Marin | 224/5 W |

*Primary Examiner*—Jerold M. Forsberg
*Attorney, Agent, or Firm*—Browdy and Neimark

[57] ABSTRACT

A water container consisting of a tubular water-impervious flexible member, adapted to be worn around the waist, advantageously when attached to a conventional belt, or forming part of such belt, or while attached to conventional suspenders or forming part of these.

7 Claims, 6 Drawing Figures

WATER CONTAINER

STATE OF PRIOR ART

Hitherto the most widespread means for taking along a supply of water by an individual person is the conventional water canteen. This is made of metal, plastic or the like, it is of rigid structure and is generally suspended from the belt worn by soldiers, hikers or the like. The main drawback of a water canteen of conventional structure is its rigidity, its whole volume in small area of the body and the fact that the weight of it is suspended from a certain location of the belt. Generally one such canteen can be carried conveniently by a single person, and the capacity of this is rather limited.

SUMMARY OF THE INVENTION

According to the present invention means are provided for the convenient transport by a single person of an adequate water supply, equal to or substantially exceeding that of a conventional water canteen. The novel means provide for the convenient transport of this water supply and the inconvenience inherent in the rigid structure of the conventional canteen is eliminated The novel water container according to the present invention comprises a tubular container adapted to be worn over or in conjunction with a conventional belt, or it may form part of a belt. The novel container may also be attached to suspenders conventionally worn by soldiers, and hikers or may form part of suspenders, and thus the carrying capacity of an individual is substantially increased, without inconvenience. The novel container according to the present invention comprises closure means, and according to a preferred embodiment means are provided for squirting water from the container. The tubular container can be formed from any suitable physiologically acceptable flexible water-impervious plastic or other suitable flexible material, such as impregnated fabric or the like.

BRIEF DESCRIPTION OF THE DRAWINGS

The invention is illustrated with reference to the enclosed schematical drawings, which are not according to scale, and in which.

DESCRIPTION OF THE PREFERRED EMBODIMENT

Figure 1:
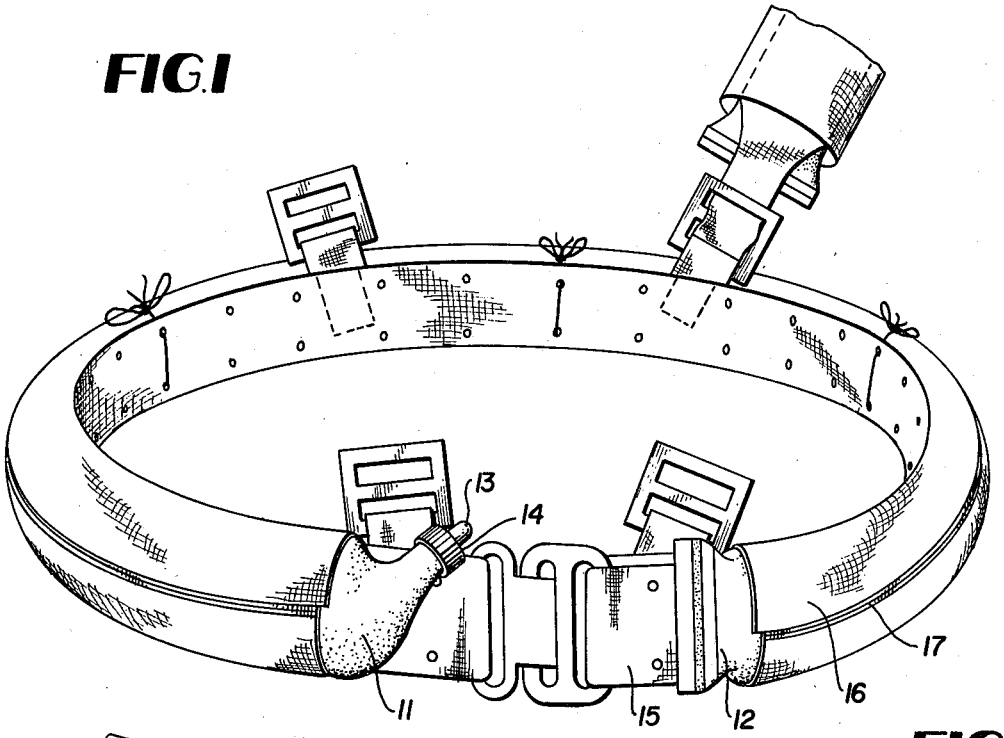
FIG. 1 is a perspective view of a container according to the invention, attached to a conventional belt.

As shown in FIG. 1, the novel container consists of a tubular member 11, one end of which is heat-sealed so as to form a seal 12, the other end of the tubular member being provided with a closure 13 which comprises a threaded member which is permanently attached to the tubular member 11, and a fitting member 14, which can be screwed off, aperture an opening for filling in and for removing water from the container. The tubular container 11 can be attached to the conventional belt 15 by means of an elongated piece of fabric 16, of rectangular form which is provided along its long edge with a zipper or similar closure 17. It is clear that the tubular member 11, filled with water, is firmly attached to the belt, and thus there can be easily carried a quantity of about 1 liter of water.

Figure 2:
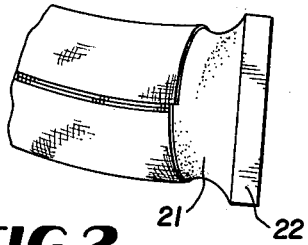
FIG. 2 is a detail of another embodiment.
Figure 3:
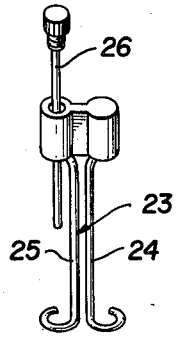
FIG. 3 is a closure for use with belts according to FIG. 2.
Figure 4:
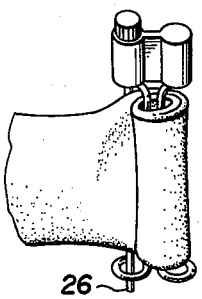
FIG. 4 is a detail of one end of a container according to FIG. 2 with a closure according to FIG. 3 in place.

According to another embodiment, the tubular member can be heat-sealed at both ends, and thus there may be provided a clean or even a sterile water supply. This is illustrated with reference to FIGS. 2, 3 and 4. The water container 21 is heat-sealed so as to provide a seal 22. When water is needed, a small section of the end is cut off, and water can be withdrawn from the container. If only part of the water is required, the tubular member is closed as shown in FIG. 4, and the member 23 seals the container in a substantially hermetical manner. The member 23 may be made of metal or rigid plastic; it consists of the two prongs 24 and 25 and the third elongated member 26, which can be lowered so as to provide the closure of the wrapped-up end of the tubular container, as shown in FIG. 4.

Figure 5:
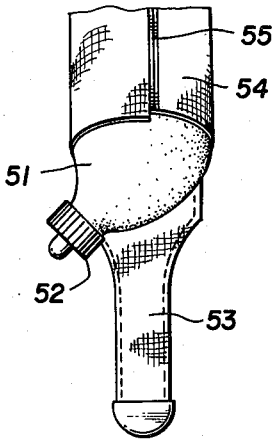
FIG. 5 is a partial view of another embodiment of the container attached to a suspender.

A further embodiment is illustrated in FIG. 5 where a tubular member 51 is arranged along the suspender 53, said member being provided with a closure 52; said tubular member 51 being held in place by means of a rectangular piece of fabric 54, provided with a zipper 55 or with similar means, such as an adhesive closure of the type replacing conventional zippers. The tubular member arranged along the suspender can easily contain about 1 liter of water, and if a belt container and two such suspender containers are worn, there is easily provided a supply of 3 liters of water.

Figure 6:
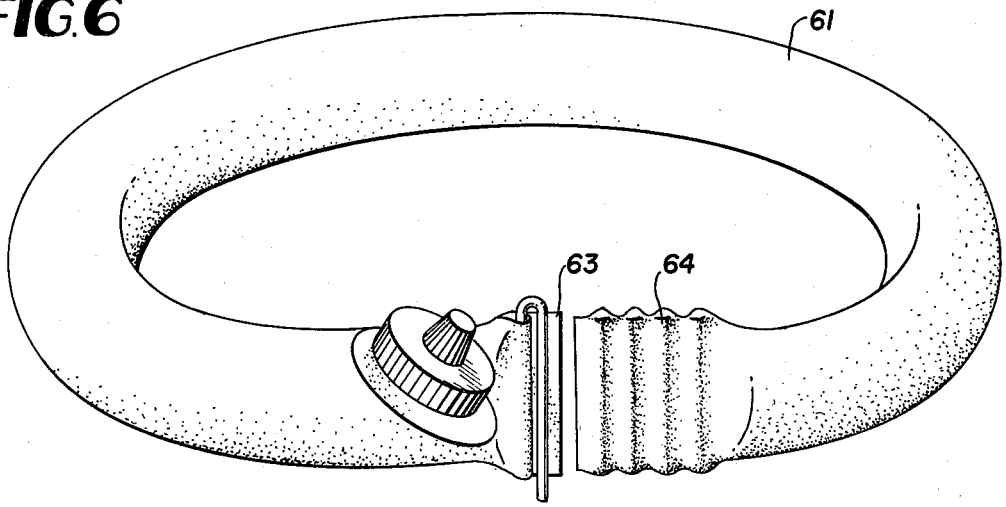
FIG. 6 is a perspective view of yet another embodiment of the container of the invention, in which the container serves as a belt and the closure is a part of it.

A further embodiment is illustrated in FIG. 6 where 61 is a sturdy plastic container of tubular shape, provided at one of its ends with a closure of the type shown in FIG. 1, the end portion of this section 63 being of the shape of a conventional belt closure, adapted to engage the ribbed end 64 of the other end of the tubular member. This provides for a good fit of the "belt container" for persons having a different circumference and belt size. It can serve as a belt and as a container. The tubular container 61 may be made of sturdy flexible plastic, such as polyethylene, polypropylene or the like or it may be made of impregnated fabric, rubber, fabric-reinforced rubber or the like.

It is clear that the tubular member which contains water (or any other desired liquid) ought to be of a size containing an adequate quantity of liquid, and it ought to be of the size of a belt worn by the person using such container, or of a smaller size. The containers of this type are conveniently worn, and this is specially important when the person travels in a plane, such as is the case with paratroopers, or with soldiers who travel in a bus or a jeep or similar means of transport and are carrying various other items. The rather bulky rigid and inconvenient water canteen is replaced by a convenient container. The novel containers can be disposable, or they may be refilled. They are easily transported in great numbers and can be handed out rapidly. When empty, they have very little weight and bulk, they are easily refilled and can be produced in large quantities even as disposables.

I claim:

1. A water container comprising: a disposable tubular water-impervious flexible member adapted to contain hermetically sealed therewithin a supply of water, said tubular water-impervious member being substantially the length of a belt; belt means to support said tubular water-impervious flexible member, said belt means comprising a flexible elongated sheathing means having two ends, whereby said sheathing wraps about said tubular flexible member when the same is juxtaposed thereto covering said tubular water-impervious member, means for attaching the sheathing when wrapped about said tubular water-impervious member, and means to attach said two ends together around a person's waist; said tubular water-impervious member being sealed at both ends thereof.

2. A water container in accordance with claim 1 wherein said tubular water-impervious flexible member has sealed therewithin sterile water.

3. A container according to claim 1 wherein said water-impervious flexible member is made of a material selected from the group consisting of polyethylene, polypropylene, polyvinylchloride, rubber and impermeable fabric.

4. A water container in accordance with claim 1 wherein said tubular water-impervious flexible member is made of flexible plastic material, and said flexible elongated sheathing means comprises a rectangular piece of fabric and said means for attaching the sheathing when wrapped about said tubular member comprises a zipper or self-adhesive means.

5. A water container in kit form comprising: a disposable tubular water-impervious flexible member adapted to contain hermetically sealed therewithin a supply of water; and belt means to support said tubular water-impervious flexible member, said belt means comprising a flexible elongated sheathing means having two ends and covering said tubular water-impervious member, and having means to attach said two ends together around a person's waist; said tubular water-impervious member being sealed at both ends thereof; and key-like means for reclosing by turning one of the ends of said water-impervious flexible member after it has been purposefully cut or pierced for removal of some of the water contained therein.

6. A water containing belt, comprising: means to hold approximately 1 liter of water comprising a tubular water-impervious flexible member adapted to extend about a person's waist; and belt means to support said tubular water-impervious flexible member, said belt means comprising a flexible elongated sheathing means extending substantially the length of and covering said tubular water-impervious member, said flexible elongated sheathing means being generally of rectangular configuration and having two ends and two long edges, said belt means having means to attach said two ends of said sheathing means together about a person's waist, and a zipper or self-adhesive means along said two long edges of said flexible elongated sheathing means, whereby said sheathing means is wrapped about said tubular water-impervious flexible member to retain it therein.

7. A water container, comprising: means to contain approximately one liter of water in the form of a tubular water-impervious flexible member; and suspender means to support said tubular water-impervious flexible member, said suspender means comprising a flexible elongated sheathing means generally in the form of a rectangle and having two ends and two long edges, the two long edges of said elongated sheathing being provided with joining means whereby said elongated sheathing extends substantially the length of and wraps about said tubular water-impervious flexible member with the long edges of said sheathing being removably joined together, said suspender means having means at the two ends of said flexible elongated sheathing to attach said two ends to a belt or to trousers, whereby said suspender passes over a person's shoulder.

* * * * *